73-151 SR
6/15/76 OR 3,962,915

United States Patent [19]
Jezequel

[11] 3,962,915
[45] June 15, 1976

[54] METHOD OF POSITIONING APPARATUSES FOR MEASURING SOIL CONDITIONS

[75] Inventor: Jean-Francois Jezequel, Binic, France

[73] Assignee: Etat Francais, Paris, France

[22] Filed: Feb. 21, 1975

[21] Appl. No.: 551,974

Related U.S. Application Data

[63] Continuation of Ser. No. 396,176, Sept. 11, 1973, abandoned.

[30] Foreign Application Priority Data

Sept. 15, 1972 France ..... 72.33388

[52] U.S. Cl. ..... 73/151
[51] Int. Cl.[2] ..... E21B 49/00
[58] Field of Search ..... 73/151, 84; 175/50

[56] References Cited

UNITED STATES PATENTS 3,500,678 3/1970 Vis ..... 73/84
3,774,718 11/1973 Igarashi et al. ..... 175/50 X

*Primary Examiner*—Jerry W. Myracle

[57] ABSTRACT

Apparatuses for measuring soil conditions are positioned using a thin probe tube of substantially constant cross-section inserted in the ground by self-drilling in such manner as to maintain the soil outside the probe in continual contact with said probe throughout the period of measuring and measuring the various physical characteristics of the soil by means of apparatuses associated with the said probe, the drilling waste being removed upwardly of the measuring zone.

1 Claim, 1 Drawing Figure

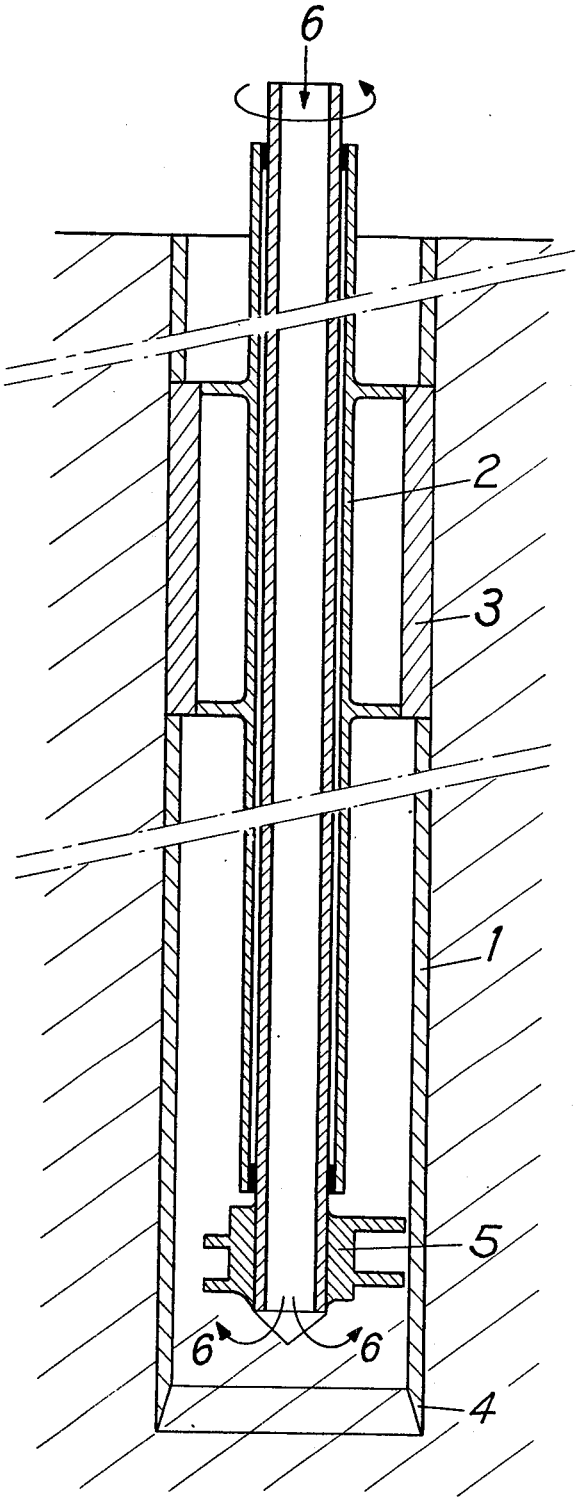
6
2
3
1
5
6
6
4

METHOD OF POSITIONING APPARATUSES FOR MEASURING SOIL CONDITIONS

This is a Continuation, of application Ser. No. 396,176, Filed Sept. 11, 1973 now abandoned.

The present invention relates to a method of positioning apparatuses for measuring soil conditions.

The method employed at present consists in drilling a hole by means of a suitable tool and, after extracting the drilling waste, positioning a probe of identical dimensions intended for studying a specific physical characteristic of the soil, then withdrawing said probe so as to again introduce into the drilled hole a further apparatus adapted for measuring another characteristic of the soil, and so on. This method has numerous disadvantages.

In fact, the ground is mechanically churned up in a major way by the various manoeuvres of drilling the hole, extracting the drilling waste and positioning the first measuring probe. Moreover, when the drillings are extracted the soil is subjected to a deformation under the influence of its own weight because of the presence of the hole which was not there in the first instance. Introduction of the measuring probe, especially when it fills the hole cross section as is the case with a pressiometric probe intended for studying the constraint-deformation diagram of the soil, causes the soil to be loaded even before the test begins since the probe acts like a piston on the walls of the bore hole.

All this brings about, from the start of the operations, errors in measuring the soil characteristics, which errors are magnified as a result of successive insertions of various measuring probes into the same bore hole. It is true that these errors can be minimised but only by drilling for every different measuring operation a hole suitable to receive an appropriate measuring probe, which would not only increase the costs but also result in an increase in the time spent.

Finally, in measuring apparatus where two phases, liquid and gaseous, are maintained under pressure for long periods of time, numerous gas bubbles may form in the liquid circuits after decompression at the end of the test, and this should obviously be avoided.

It is an object of the present invention to mitigate the above mentioned disadvantages by preventing any movement of the soil to be tested prior to the actual measuring operation, by reducing the positioning manoeuvres to a minimum.

A further object of the invention is to enable a succession of measuring instruments to be positioned in one and the same hole and to measure the soil characteristics in a very precise manner with automation of the operation of the test, and the recording of results, without the necessity of utilising for this purpose a series of special rods over the entire height of the drilled hole.

According to the present invention there is provided a method of positioning apparatuses for measuring ground conditions, comprising positioning in the ground, by self-drilling, a probe tube of substantially constant cross-section so as to maintain the ground outside the probe in permanent contact with said probe tube throughout the period of measuring; removing the drilling waste from above a desired measuring zone; and measuring the various desired physical characteristics by means of instruments associated with the said probe tube.

The FIGURE shows a cross-sectional view of the probe tube of the present invention placed in position in the earth.

Referring to the attached Drawing, the probe tube 1 may advantageously be placed in the ground by pressure, by means of a second tube 2 adapted to serve as guide for the measuring instruments 3 associated with the probe tube 1.

Preferably the probe tube is cylindrical and has a lower cutting rim 4, optionally partially threaded so as to receive a suitable fragmenting tool 5.

An advantage of the present invention resides in the fact that the influence of the weight of the earth on the condition of the soil bordering the probe tube 1 is virtually nil since the soil is now no longer free to expand radially inwardly of the bore hole by virtue of the fact that it is permanently supported by the probe tube 1.

A further advantage is that the positioning of the probe tube 1 cannot cause any lateral expansion of the ground before the test is carried out since the drilling merely causes a lateral smoothing of the ground bordering on the hole and the influence of this smoothing on the measurements is negligible. In this connection it should be noted that when a self-drilling pressiometric probe is being positioned the effect of the bentonite and the water of injection 6 is nil since the soil to be tested is not in contact with the injected fluid, hence the water content of the soil is not modified; in the traditional methods the bentonite is capable of laterally rising between the measuring probe and the walls of the bore hole, thus bringing about errors in the measurement of total and interstital pressures.

In the case of positioning a self-tapping pressiometric probe there is a further advantage in addition to those indicated above in that there is no loss of volume or of pressure through expansion of the tubing under the influence of internal pressure or temperature variations for example.

By virtue of the present invention all the measuring apparatuses conventionally employed with their own separate bodies can be disposed in the probe tube which serves as a common body for all these apparatuses.

This applies in particular to a scissometer the body of which is formed by the probe tube into which is placed a motor driving a mobile element having an external diameter the same as the internal diameter of the probe tube and having a low height relative to that of the probe tube, the said mobile element being disposed above the probe tube when they are sunk vertically into the bore hole and having at its periphery small vanes which are short and thin, this being possible by virtue of the fact that the soil bordering the probe tube is still intact. The use of very short vanes which are consequently subjected to only weak stresses enables the soil to be minimally modified by their contact, in contrast to the vanes of conventional scissometers which have to be very thick since they have to search the broken soil of the bore hole. Moreover, by virtue of the positioning method, the number of vanes may be increased thereby preventing the phenomenon of progressive rupture in the ground.

Likewise, it is possible to use an oedometer for taking measurements in situ, the thin probe tube in this case being of the core drilling kind having a stationary piston and positioned by force with the aid of a tube connected to the said probe tube by bolts or other connection means. The said second tube in this case can simultaneously serve as guide means for a further drilling member if required, For use with such an oedometer the probe tube comprises bands of calcined bronze which are connected to one another so as both to ensure drainage from the so formed ring of soil and to enable the degree of horizontal compressibility of the soils to be better observed, and this on a soil sample core or "plug" of 20 cm thickness or more, if necessary.

Other measuring apparatuses employing a probe tube may, of course, be utilised, subject to a few modifications suitable to the nature of the measurements to be taken, and can be positioned in the manner described above by way of example for the pressiometer, the scissometer and the oedometer. This applies especially to the self-drilling piezometer whose filtering portion is thus positioned without altering the permeability of the ground; to the self-tapping rigid friction probe with which the friction between virgin soil and a tube is measured in the manner of simulating driving a pile so that positioning taking place without the soil being disturbed; to the self-tapping pressio-scissometer which enables the internal friction angle of soils to be measured; and to many others.

We claim:

1. A method for positioning apparatuses for measuring ground conditions below the surface thereof comprising mounting a plurality of measuring apparatuses on a cylindrical probe tube so that said measuring apparatuses form an intermediate portion of the cylindrical wall thereof while maintaining a longitudinal central opening therein for fixedly receiving a second guide tube in spaced relation in the central opening, said probe tube having fragmentation means at the bottom of and coextensive with the cylindrical wall thereof, the lower end of said second tube being above the bottom end of said probe tube, driving the cylindrical probe tube vertically into the ground until the measuring apparatuses are embedded therein by pressure on the second tube, passing an injection fluid downwardly through said second tube to entrain fragmented ground matter at the bottom thereof and passing the fluid with entrained matter upwardly in the space between said second tube and said probe tube, whereby appropriate measurements can be taken in the undisturbed ground surrounding said probe tube which remains in contact with the outer wall of said cylindrical probe tube and said measuring apparatuses.

* * * * *